US011857072B2

(12) United States Patent
Haid

(10) Patent No.: US 11,857,072 B2
(45) Date of Patent: Jan. 2, 2024

(54) DRAWER REAR WALL

(71) Applicant: Julius Blum GmbH, Hoechst (AT)

(72) Inventor: Stefan Haid, Fussach (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 17/575,123

(22) Filed: Jan. 13, 2022

(65) Prior Publication Data

US 2022/0133036 A1 May 5, 2022

Related U.S. Application Data

(63) Continuation of application No. PCT/AT2020/060213, filed on May 28, 2020.

(30) Foreign Application Priority Data

Jul. 18, 2019 (AT) ..... A 50651/2019

(51) Int. Cl.
*A47B 88/90* (2017.01)

(52) U.S. Cl.
CPC ..... *A47B 88/941* (2017.01); *A47B 88/90* (2017.01); *A47B 2088/902* (2017.01); *A47B 2210/01* (2013.01); *A47B 2210/02* (2013.01); *A47B 2210/09* (2013.01)

(58) Field of Classification Search
CPC ... A47B 88/90; A47B 88/941; A47B 88/0014; A47B 2088/902; A47B 2088/0037; A47B 2210/01; A47B 2210/09
See application file for complete search history.

(56) References Cited

U.S. PATENT DOCUMENTS 4,099,815 A 7/1978 Cox et al.
5,364,180 A 11/1994 Berger
5,538,339 A 7/1996 Rock et al.
5,588,730 A * 12/1996 Rock ..... A47B 88/941 312/263
7,857,404 B2 * 12/2010 Lam ..... A47B 88/941 312/263

(Continued)

FOREIGN PATENT DOCUMENTS

AT 401 852 5/1996
AT 401852 B * 11/1996 ..... A47B 88/0014

(Continued)

OTHER PUBLICATIONS

International Search Report dated Jul. 9, 2020 in International (PCT) Application No. PCT/AT2020/060213.

(Continued)

*Primary Examiner* — Andrew M Roersma
(74) *Attorney, Agent, or Firm* — Wenderoth, Lind & Ponack, L.L.P.

(57) ABSTRACT

A drawer rear wall for a drawer includes a first fastening portion for fixing the drawer rear wall to a first sidewall of the drawer, and a second fastening portion for fixing the drawer rear wall to a second sidewall of the drawer. The two fastening portions of the drawer rear wall are mutually spaced from one another in a longitudinal direction of the drawer rear wall by a middle portion, and a first wall thickness of at least one of the two fastening portions, preferably both fastening portions, is larger than a second wall thickness of the middle portion.

17 Claims, 7 Drawing Sheets

(56) References Cited

U.S. PATENT DOCUMENTS

| | | | | |
|---|---|---|---|---|
| 8,998,356 | B2 * | 4/2015 | Gasser | F16B 12/26 312/265.5 |
| 9,345,157 | B2 | 5/2016 | Joist et al. | |
| 10,772,422 | B1 * | 9/2020 | Chen | A47B 88/941 |
| 2014/0167586 | A1 * | 6/2014 | Schallert | A47B 88/40 312/330.1 |
| 2015/0091419 | A1 | 4/2015 | Joist et al. | |
| 2017/0280875 | A1 * | 10/2017 | Buckley | A47B 57/34 |
| 2017/0303686 | A1 * | 10/2017 | Schneider | A47B 88/90 |
| 2019/0357678 | A1 * | 11/2019 | Staufenberg | A47B 88/90 |

FOREIGN PATENT DOCUMENTS

| | | | | |
|---|---|---|---|---|
| CN | 101053469 | | 10/2007 | |
| CN | 101511226 | | 8/2009 | |
| CN | 104519686 | | 4/2015 | |
| CN | 108371431 | A * | 8/2018 | A47B 88/40 |
| DE | 26 23 709 | | 12/1976 | |
| DE | 93 11 436 | | 8/1992 | |
| DE | 203 07 353 | | 9/2004 | |
| DE | 20 2009 005 110 | | 2/2011 | |
| DE | 202010007429 | U1 * | 11/2011 | A47B 88/941 |
| DE | 20 2011 051 625 | | 2/2012 | |
| DE | 20 2012 000 898 | | 5/2012 | |
| DE | 202014104931 | U1 * | 2/2016 | A47B 88/941 |
| DE | 202015100773 | U1 * | 6/2016 | A47B 88/90 |
| DE | 102017103595 | A1 * | 8/2018 | A47B 88/941 |
| EP | 0 551 575 | | 7/1993 | |
| EP | 2 628 409 | | 8/2013 | |
| JP | 7-508442 | | 9/1995 | |
| JP | 2008-73283 | | 4/2008 | |
| WO | WO-2010130581 | A1 * | 11/2010 | A47B 88/941 |
| WO | WO-2011083214 | A1 * | 7/2011 | A47B 96/061 |

OTHER PUBLICATIONS

Chinese Search Report dated Apr. 21, 2023 in corresponding Chinese Patent Application No. 202080051595.7.

* cited by examiner

DRAWER REAR WALL

BACKGROUND OF THE INVENTION

The present invention relates to a drawer rear wall for a drawer. The drawer rear wall comprises a first fastening portion for fixing the drawer rear wall to a first sidewall of the drawer, and a second fastening portion for fixing the drawer rear wall to a second sidewall of the drawer. The two fastening portions of the drawer rear wall are mutually spaced from one another in a longitudinal direction of the drawer rear wall by a middle portion.

Moreover, the invention relates to a drawer comprising a first sidewall, a second sidewall and a drawer rear wall of the type to be described.

Moreover, the invention relates to a method for producing a drawer rear wall of the type to be described.

Drawer rear walls are frequently formed of a steel panel or of an extruded aluminum profile. Depending on the width and the height of the drawer rear wall, a relatively large amount of material is required for producing the drawer rear wall, particularly because a certain material thickness (for example 1 mm) has to be provided for sufficient stability of the drawer rear wall. Besides a high material consumption, also the weight of the drawer rear wall and the costs for the production are correspondingly increased.

SUMMARY OF THE INVENTION

It is an object of the present invention to propose a drawer rear wall of the type mentioned in the introductory part, thereby avoiding the above-discussed drawbacks. In particular, the compatibility of the fastening portions for connecting the drawer rear wall to existing fastening systems of the drawer sidewalls shall further be guaranteed.

According to the invention, a first wall thickness of at least one of the two fastening portions, preferably of both fastening portions, is larger than a second wall thickness of the middle portion. In other words, it is possible that the wall thickness of the middle portion of the drawer rear wall can be formed with a smaller wall thickness (for example 0.5 mm) than the wall thickness of the fastening portions (for example 1.0 mm). Therefore, the material consumption, the costs, and also the weight of the middle portion can be reduced accordingly.

On the contrary, the fastening portions for connecting to the sidewalls shall further be connectable with existing fastening systems of the sidewalls. In order to obtain a larger wall thickness of the fastening portions, in comparison to the one of the middle portion, it can be provided, for example, that the larger wall thickness of the fastening portions can be achieved by a corresponding bending process (foldover, flanging) or by a profiling method (forming process) of a flat material in an initial condition. As an alternative thereto, it can be provided that the connection of the thinner middle portion to the fastening system of the sidewalls can be implemented by a mounting device separate from the middle portion.

According to an embodiment, the first wall thickness is at least substantially twice as large than the first wall thickness. The first wall thickness can be approximately 1.0 mm and/or the second wall thickness can be approximately 0.5 mm.

The drawer rear wall can consist of at least one metallic material, preferably steel and/or aluminum. The middle portion of the drawer rear wall can be formed of an extruded profile.

According to an embodiment, the drawer rear wall has an integral one-piece configuration, and at least one of the two fastening portions, preferably both fastening portions, is or are at least partially formed by at least one foldover of an edge of the middle portion.

With an alternative embodiment, the middle portion and at least one of the two fastening portions, preferably both fastening portions, are configured as components separate from one another. The middle portion and at least one of the two fastening portions, preferably both fastening portions, are configured to be, preferably releasably, connected to one another by at least one mounting device.

Preferably, the at least one mounting device includes at least one plug connection, a locking connection, and/or a snap-connection device. The middle portion can include at least one mounting limb for connecting the middle portion to one of the fastening portions, and can be preferably provided that the mounting limb is connected to the middle portion by a step-shaped portion. It can be preferably provided that at least one of the fastening portions, preferably both fastening portions, includes or include at least one spring element for pressing the at least one mounting limb against a wall of the fastening portion.

The middle portion can include at least one transverse limb arranged on a longitudinal edge. At least one fastening portion, preferably both fastening portions, can include openings for partially receiving fastening elements, preferably locking elements, arranged on the sidewalls.

The drawer according to the invention includes a first sidewall, a second sidewall, and a drawer rear wall of the type in question. The drawer rear wall is connected to the first sidewall via the first fastening portion and is connected to the second sidewall via the second fastening portion. The drawer can include a front wall aligned substantially parallel to the drawer rear wall and/or can include a drawer bottom.

The method according to the invention for producing a drawer rear wall is characterized in that either:

- the drawer rear wall has an integral one-piece configuration, and wherein at least one of the two fastening portions, preferably both fastening portions, is or are at least partially formed by at least one foldover of an edge of the middle portion, or
- the middle portion and at least one of the two fastening portions, preferably both fastening portions, are provided as components which are separate from one another and which are connected to one another.

BRIEF DESCRIPTION OF THE DRAWINGS

Further details and advantages of the present invention will be explained with the aid of the embodiments shown in the drawings.

DETAILED DESCRIPTION OF THE INVENTION

Figure 1:
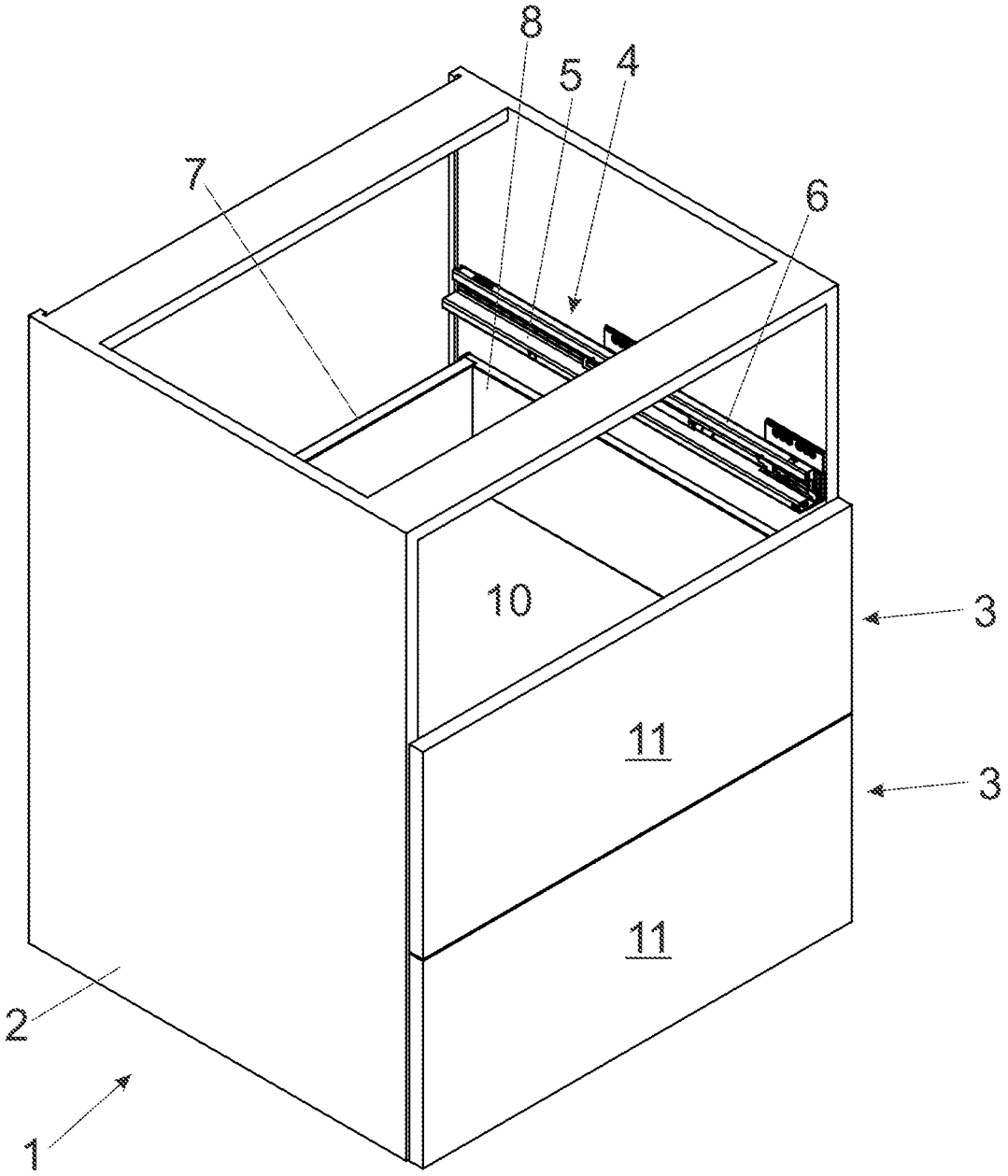
FIG. 1 shows an item of furniture comprising a furniture carcass and drawers displaceably supported relative to the furniture carcass by drawer pull-out guides.

FIG. 1 shows a perspective view of an item of furniture 1 comprising a furniture carcass 2, in which drawers 3 are displaceably supported relative to the furniture carcass 2 by drawer pull-out guides 4. Each of the drawer pull-out guides 4 includes a carcass rail 5 configured to be fixed to the furniture carcass 2, and at least one extension rail 6 displaceable relative to the carcass rail 5. The drawers 3 include a drawer rear wall 7, sidewalls 8 and 9, a drawer bottom 10 and a front wall 11 aligned in a parallel relationship to the drawer rear wall 7.

Figure 2A:
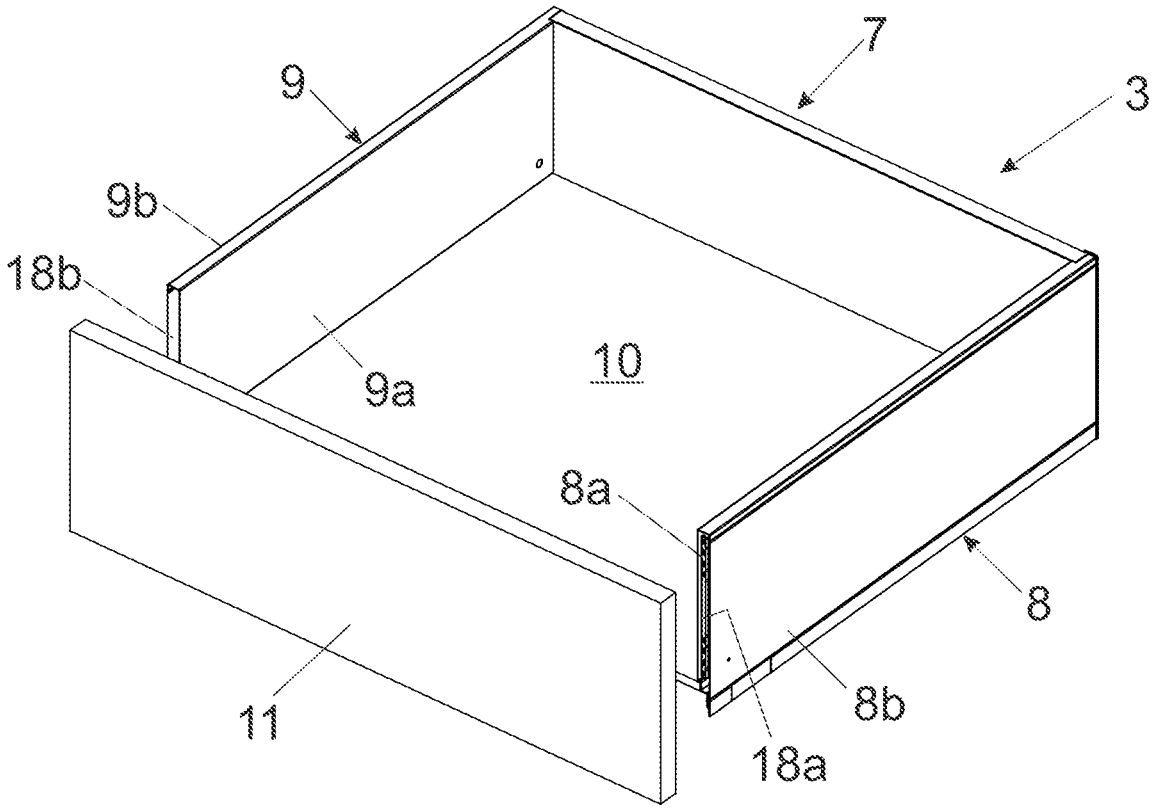
FIG. 2*a*, 2*b* show the drawer and a connecting region between the drawer rear wall and the sidewall in perspective views.

FIG. 2*a* shows a perspective view of the drawer 3, the drawer 3 having a first sidewall 8 and a second sidewall 9. Each of the sidewalls 8, 9 is configured as a hollow-chamber profile, and the first sidewall 8 includes an inner profiled wall 8*a* and an outer profiled wall 8*b* spaced from the inner profiled wall 8*a*. The second sidewall 9 also includes an inner profiled wall 9*a* and an outer profiled wall 9*b*. The drawer rear wall 7 extends between the two sidewalls 8, 9 of the drawer 3. The front wall 11 is configured to be locked with usually provided locking devices 18*a*, 18*b* of the sidewalls 8, 9 via holding portions (not shown), and the holding portions are to be fixed to the rear side of the front wall 11. Each of the locking devices 18*a*, 18*b* is located between the profiled walls 8*a*, 8*b* and 9*a*, 9*b* of the sidewalls 8, 9.

Figure 2B:
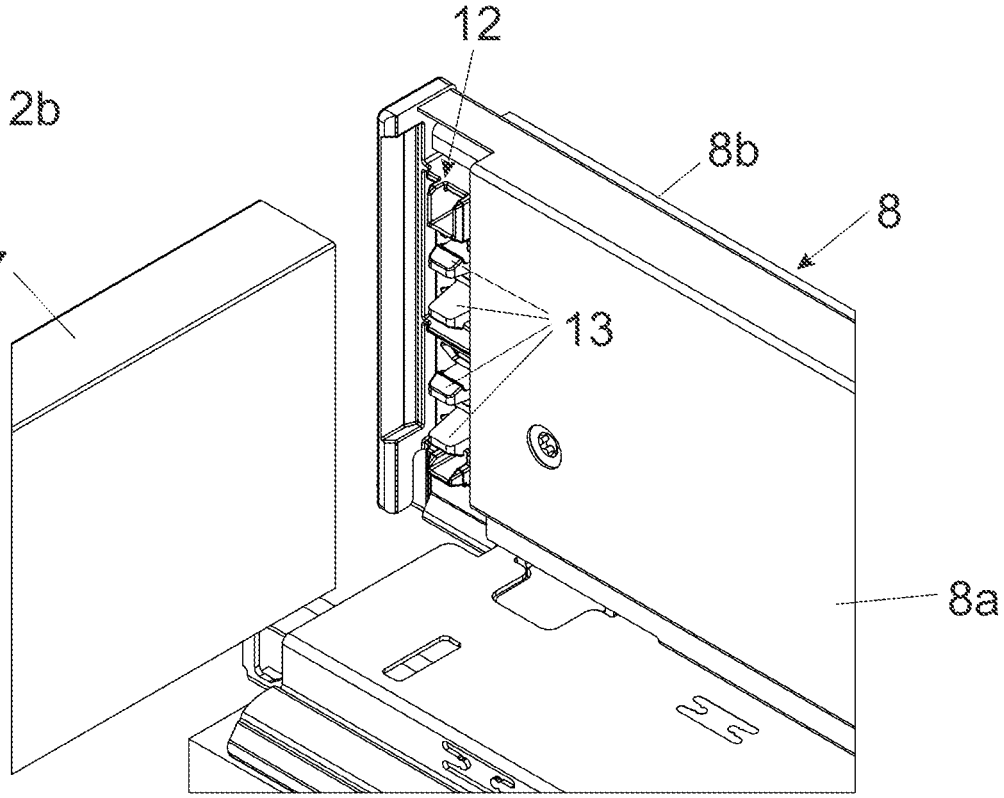

FIG. 2*b* shows the connecting region between the drawer rear wall 7 and the sidewall 8 of the drawer 3. A recess 12 is provided in the rear end region of the sidewall 8, and a fastening system of the sidewall 8 is arranged within the recess 12. The fastening system of the sidewall 8 usually includes at least one, preferably a plurality of, fastening element(s) 13. It is preferable that the fastening elements 13 are configured as locking elements for locking the drawer rear wall 7 to the sidewall 8 in a form-locking manner. The fastening elements 13 can be configured, for example, as spring tongues, in particular made of plastic. In a connected condition between the drawer rear wall 7 and the sidewall 8, the fastening elements 13 are partially received within provided openings 16 (FIG. 3*b*, FIG. 5*a*) of the drawer rear wall 7.

Figure 3A:
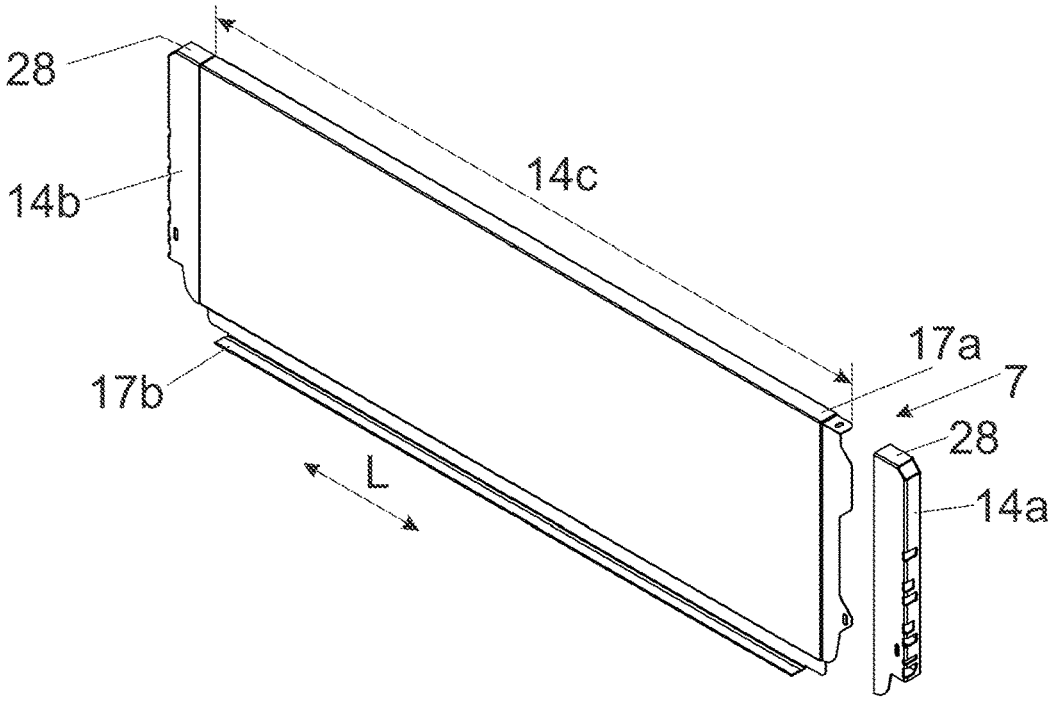
FIG. 3*a*, 3*b* are perspective views of a first embodiment of a drawer rear wall and an enlarged detail view thereof.

FIG. 3*a* shows a first embodiment of a drawer rear wall 7. The drawer rear wall 7 includes a first fastening portion 14*a* for connecting the drawer rear wall 7 to the first sidewall 8 of the drawer 3, and a second fastening portion 14*b* for connecting the drawer rear wall 7 to the second sidewall 9 of the drawer 3. The two fastening portions 14*a*, 14*b* of the drawer rear wall 7 are mutually spaced from one another in a longitudinal direction (L) of the drawer rear wall 7 by a middle portion 14*c*. According to the invention, it is provided that a first wall thickness (W1, FIG. 4*b*, FIG. 5*e*) of at least one of the fastening portions 14*a*, 14*b*, preferably of both fastening portions 14*a*, 14*b*, is larger than a second wall thickness (W2, FIG. 4*b*, FIG. 5*e*) of the middle portion 14*c*. For example, it can be provided that the first wall thickness (W1) of the fastening portions 14*a*, 14*b* is approximately 1.0 mm and/or that the second wall portion (W2) of the middle portion 14*c* is approximately 0.5 mm.

The middle portion 14*c* and at least one of the two fastening portions 14*a*, 14*b*, preferably both fastening portions 14*a*, 14*b*, are configured as components separate from one another. The middle portion 14*c* and/or the fastening portions 14*a*, 14*b* can consist of a metallic material, preferably steel and/or aluminum. In order for the fastening portions 14*a*, 14*b* to be further connectable to the sidewalls 8 and 9, the fastening portions 14*a*, 14*b* have a conventional first wall thickness (for example 1 mm). On the contrary, the middle portion 14*c* is designed with a smaller second wall thickness (W2), and the middle portion 14*c* can be formed of an extruded profile.

Figure 3B:
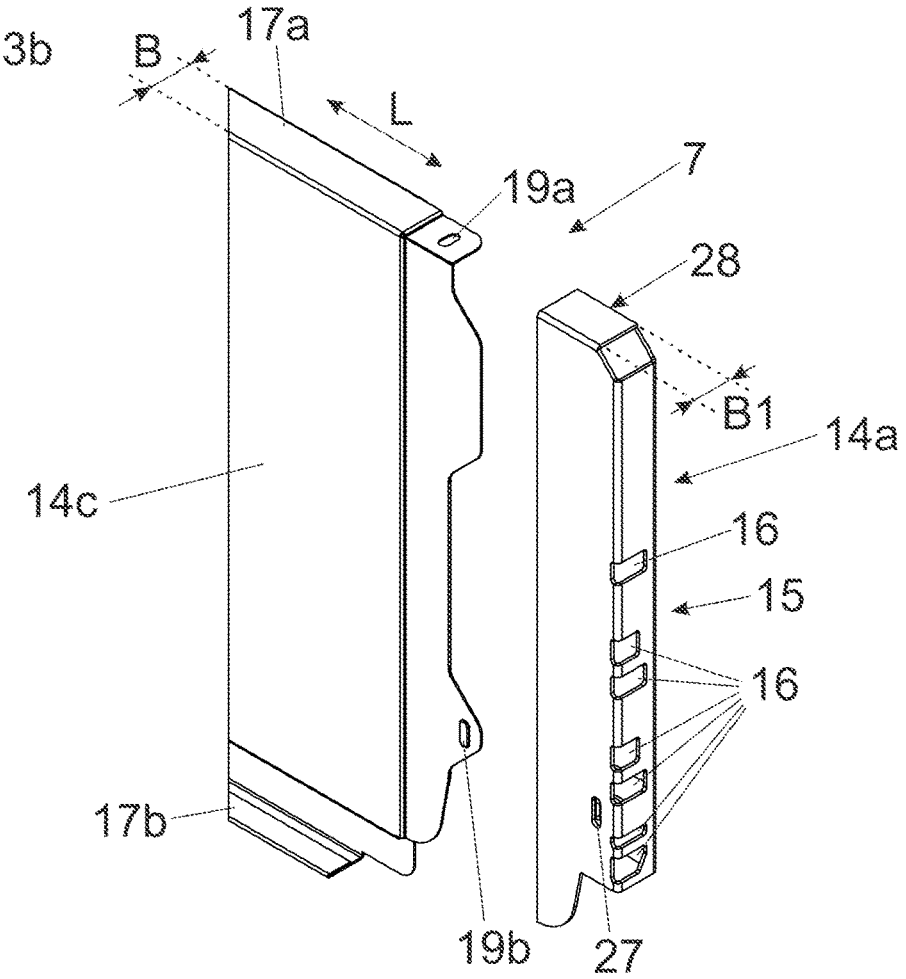

FIG. 3*b* shows the drawer rear wall 7 and the first fastening portion 14*a* in an enlarged detail view. The first fastening portion 14*a* includes a mounting device 15 configured to releasably connect the first fastening portion 14*a* (and therewith the middle portion 14*c*) to the sidewall 8. The mounting device 15 can include at least one least one plug connection, a locking connection, and/or a snap-connection device. In the shown embodiment, the mounting device 15 includes at least one or a plurality of openings 16 configured to receive the fastening elements 13 of the sidewalls 8, 9, as shown in FIG. 2*b*.

The drawer rear wall 7 includes at least one transverse limb 17*a*, 28 extending over an entire length of the drawer rear wall 7 and having a constant width.

According to an embodiment, it can be provided that the middle portion 14*c* includes at least one transverse limb 17*a* having a first width (B), and that at least one of the two fastening portions 14*a*, 14*b*, preferably both fastening portions 14*a*, 14*b*, includes or include a further transverse limb 28 having a second width (B1), the first width (B) and the second width (B1) having substantially an identical size.

It can be preferably provided that the at least one transverse limb 17*a* of the middle portion 14*c* and the at least one further transverse limb 28 of a fastening portion 14*a*, 14*b* or of the fastening portions 14*a*, 14*b*, in a connected condition, are arranged in a common plane.

The middle portion 14*c* includes at least one transverse limb 17*a*, 17*b* formed on a longitudinal edge. The first transverse limb 17*a* serves for preventing a sharp-edged longitudinal edge of the middle portion 14*c*, whereas the second transverse limb 17*b* is provided for supporting the drawer bottom 10. The two transverse limbs 17*a*, 17*b* extend parallel to one another in the longitudinal direction (L).

According to an embodiment, it can be provided that the at least two transverse limbs 17*a*, 17*b* protrude from the middle portion 14*c* in different directions, and/or the at least two transverse limbs 17*a*, 17*b* are mutually spaced from one another by a height of the middle portion 14*c*.

The middle portion 14*c* can include at least one protrusion 19*a*, 19*b* or a recess for connecting to the fastening portions 14*a*, 14*b*. The protrusions 19*a*, 19*b* engage into corresponding openings 27 of the fastening portions 14*a*, 14*b* in a connected condition. In a mechanical reversal, it is, of course, also possible that the protrusions 19*a*, 19*b* are formed on the fastening portions 14*a*, 14*b* and the openings 27 are formed on the middle portion 14*c*. However, the connection between the middle portion 14*c* and the fastening portions 14*a*, 14*b* can be established in any other manner, for example by means of conventional form-locking and/or force-locking connection devices.

Figure 4A:
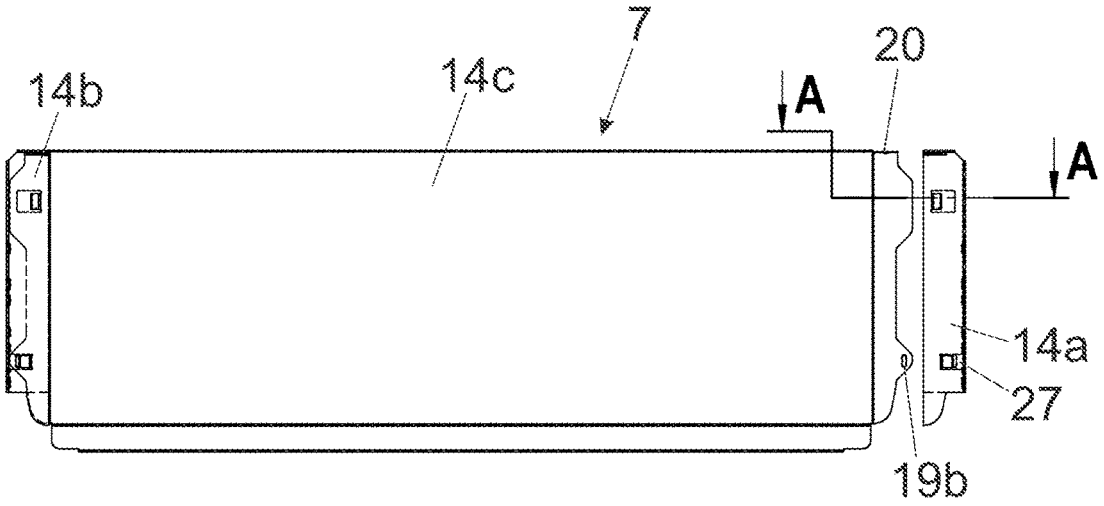
FIG. 4*a*-4*c* is a view of a drawer rear wall from the front, as well as a separated condition and a connected condition between the middle portion and the fastening portion.

FIG. 4*a* shows the drawer rear wall 7 with the middle portion 14*c* and the two lateral fastening portions 14*a*, 14*b* in a view from the front, that is to say seen from the interior of the drawer 3.

Figure 4B:
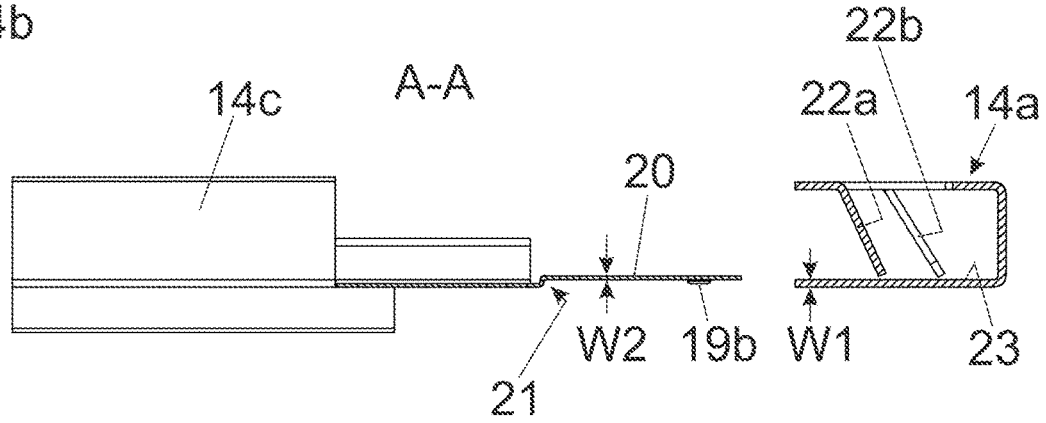

FIG. 4*b* shows a cross-sectional view along the plane A-A depicted in FIG. 4*a*, in which the middle portion 14*c* and the fastening portion 14*a* to be connected therewith can be seen. A first wall thickness (W1) of one of the two fastening portions 14*a*, 14*b*, preferably of both fastening portions 14*a*, 14*b*, is larger than a second wall thickness (W2) of the middle portion 14*c*.

The middle portion 14*c* can include at least one mounting limb 20 for connecting the middle portion 14*c* to one of the fastening portions 14*a*, 14*b*, the mounting limb 20 being connected to the middle portion 14*c* by a step 21. It can be preferably provided that at least one of the fastening portions 14*a*, 14*b*, preferably both fastening portions 14*a*, 14*b*, includes or include at least one spring element 22*a*, 22*b* configured to press the at least one mounting limb 20 against a wall 23 of the fastening portion 14*a*, 14*b*. In the shown embodiment, the fastening portion 14*a* includes two spring elements 22*a*, 22*b* mutually spaced from one another in a height direction. For example, the spring elements 22*a*, 22*b* can be configured as tabs bent from the fastening portions 14*a*, 14*b*. The mounting limb 20 of the middle portion 14*c* can include at least one protrusion 19*b* configured to be received in a corresponding opening 27 of the fastening portion 14*a* in a connected condition between the middle portion 14*c* and the fastening portion 14*a*.

Figure 4C:
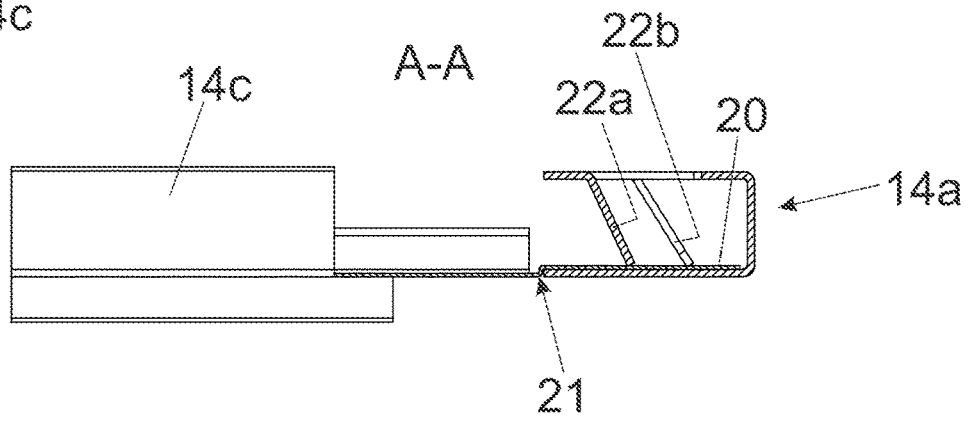

FIG. 4*c* shows the connected condition between the middle portion 14*c* and the fastening portion 14*a*, the spring elements 22*a*, 22*b* urging the mounting limb 20 against the wall 23 of the fastening portion 14*a*. By the spring elements 22*a*, 22*b*, the protrusion 19*b* can also be pressed into the corresponding opening 27 of the fastening portion 14*a*. By virtue of the step 21, it can be ensured that the transition region between the middle portion 14*c* and the fastening portion 14*a* is aligned flush and, therefore, can be formed in a visually attractive manner.

Figure 5A:
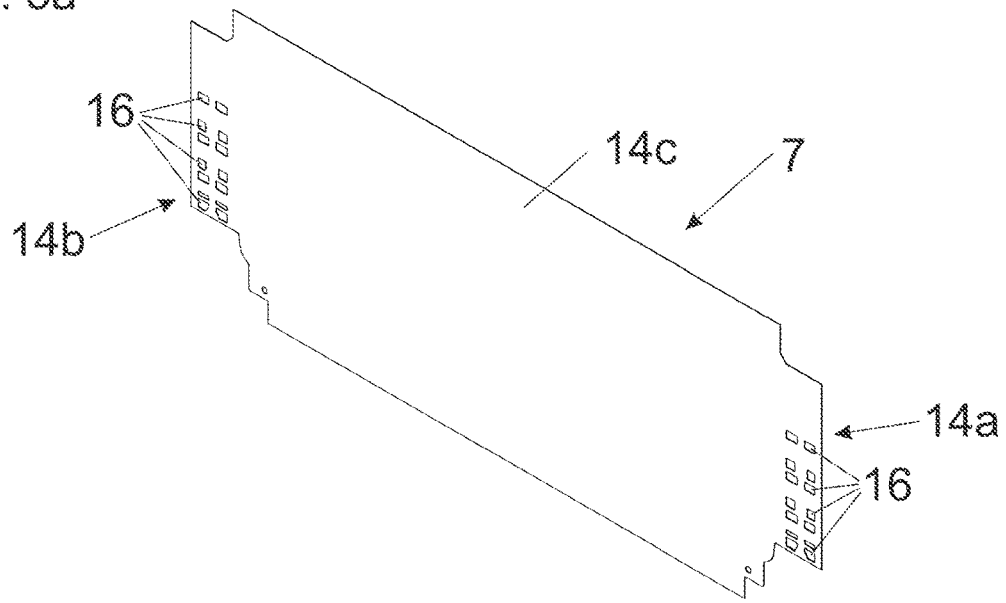
FIG. 5*a*-5*e* show a second embodiment of a drawer rear wall configured as an integral one-piece component, and the production process of the fastening portions of the drawer rear wall configured as an integral one-piece component.

FIG. 5*a* shows an embodiment of a drawer rear wall 7, in which the middle portion 14*c* and the two fastening portions 14*a*, 14*b* are formed together to have an integral one-piece configuration. In an initial condition, the drawer rear wall 7 is configured flat and has a smaller second wall thickness (W2). The fastening portions 14*a*, 14*b* can be produced, for example, by a bending procedure as shown in FIGS. 5*b*-5*e*. On both end regions of the drawer rear wall 7, a plurality of openings 16 is provided, and the openings 16 are provided for receiving the fastening elements 13 of the sidewalls 8, 9, as shown in FIG. 2*b*.

Figure 5B:
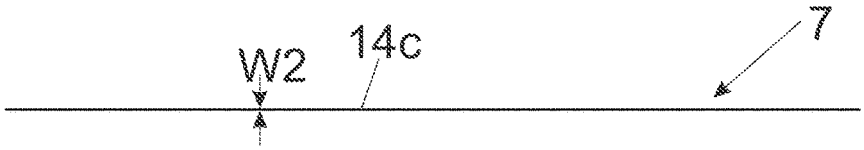

FIG. 5*b* shows the drawer wall 7 as depicted in FIG. 5*a* in a view from the top, and the drawer rear wall 7 is configured flat and has a reduced first wall thickness (W2).

Figure 5C:
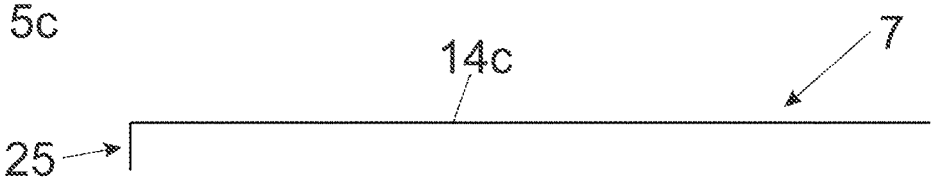

FIG. 5*c* shows the drawer rear wall 7, in which an edge 25 of the drawer rear wall 7 is bent perpendicularly in a forward direction in relation to the middle portion 14*c*.

Figure 5D:
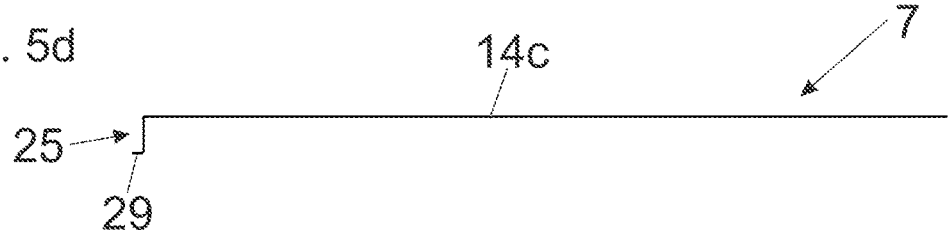

FIG. 5*d* shows that a partial portion 29 of the edge 25 is bent by 90° in a direction facing away from the fastening portion 14*a*.

Figure 5E:
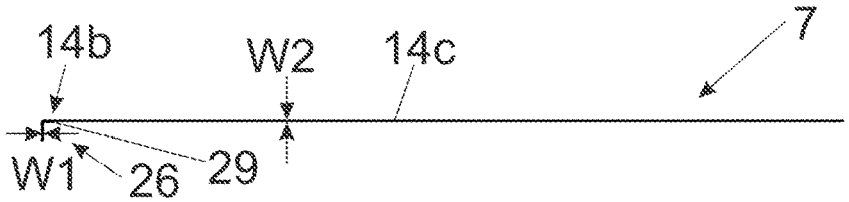

FIG. 5*e* shows that the edge 25, from the position shown in FIG. 5*d*, is bent via a foldover 26. Therefore, a length of the edge 25 is approximately halved and the bent partial portion 29 according to FIG. 5*d* bears against an inner side (that is to say on a side facing towards the middle of the drawer 3) of the middle portion 14*c*. As a result, the fastening portion 14*b* has a doubled first wall thickness (W1) than the second wall thickness (W2) of the middle portion 14*c*. Therefore, the fastening portion 14*b* can be connected via the openings 16 to fastening elements 13 of the sidewalls 8, 9. The edge 25, due to the partial portion 29 bearing against the inner side of the middle portion 14*c*, can be stably arranged in relation to the middle portion 14*c*.

Figure 6A:
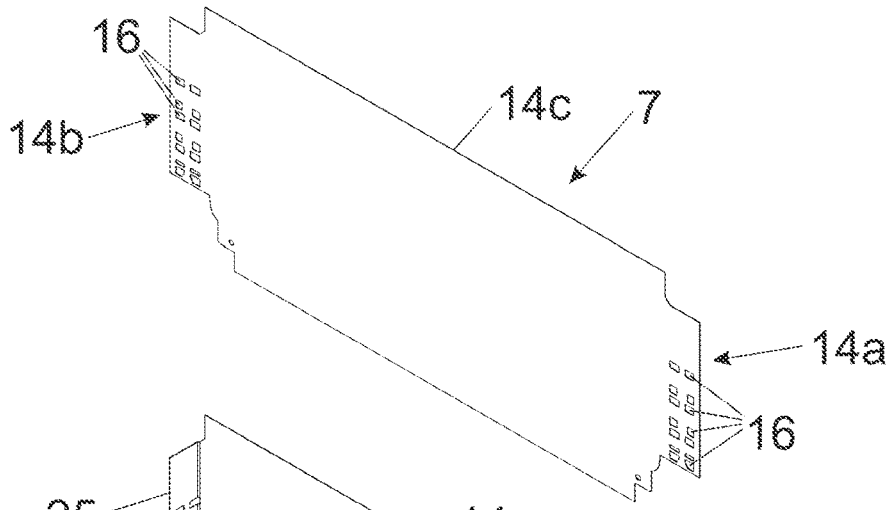
FIG. 6*a*-6*d* show the production process of the drawer rear wall in a temporal sequence.
Figure 6B:
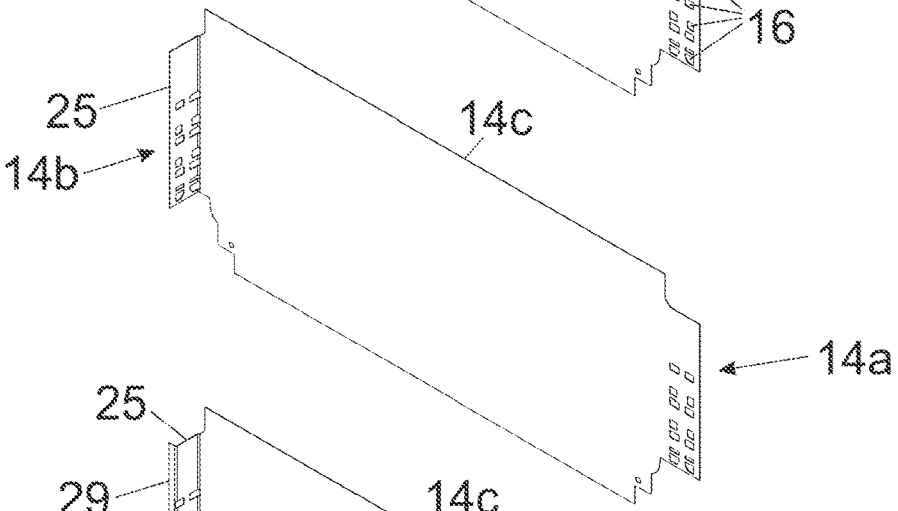
Figure 6C:
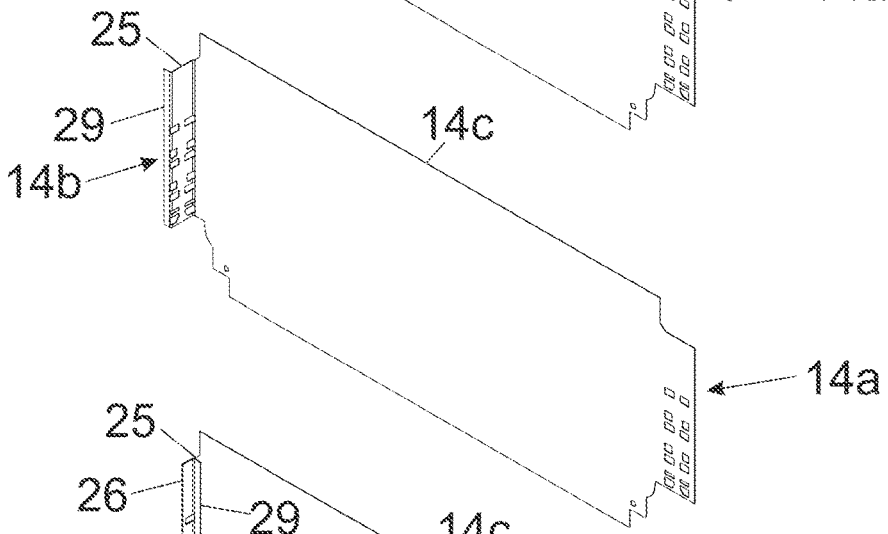
Figure 6D:
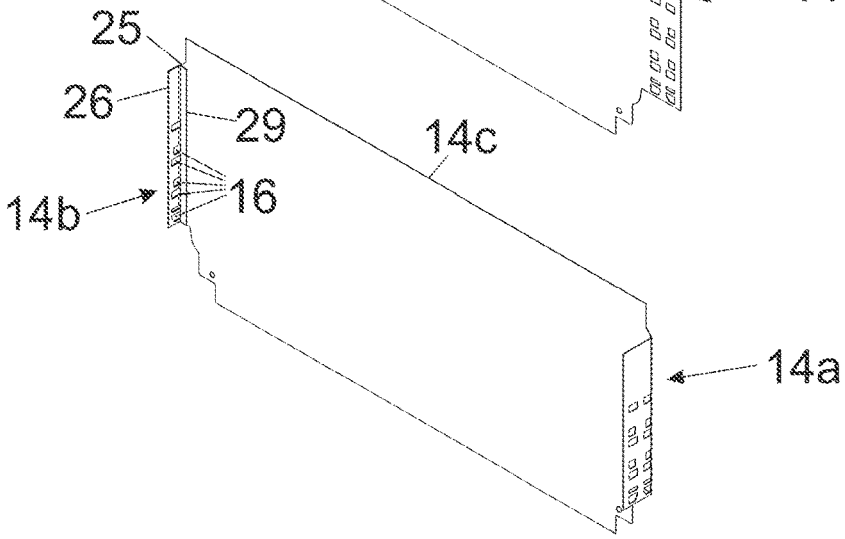

FIG. 6*a*-6*d* show the production process of a fastening portion 14*b* in a temporal sequence, in which the drawer rear wall 7 is firstly present in a flat initial condition (FIG. 6*a*). In a first step, the edge 25 with the openings 16 is bent perpendicularly in a forward direction (FIG. 6*b*). Subsequently, the partial portion 29 is bent perpendicularly from the edge 25, namely in a direction facing away from the fastening portion 14*a* (FIG. 6*c*). In a further step, the edge 25 is bent approximately by 180° in a direction facing towards the middle portion 14*c*, whereby the foldover 26 can be produced and the partial portion 29 of the edge 25 bears against the middle portion 14*c*.

For producing the other fastening portion 14*c*, the procedure is performed in an analogous manner.

Subsequently, the two transverse limbs 17*a*, 17*b* (FIG. 3*a*, 3*b*) need to be bent perpendicularly from the middle portion 14*c*, namely such that the two transverse limbs 17*a*, 17*b* extend in a parallel relationship to one another and protrude from the middle portion 14*c* in different directions.

Figure 7:
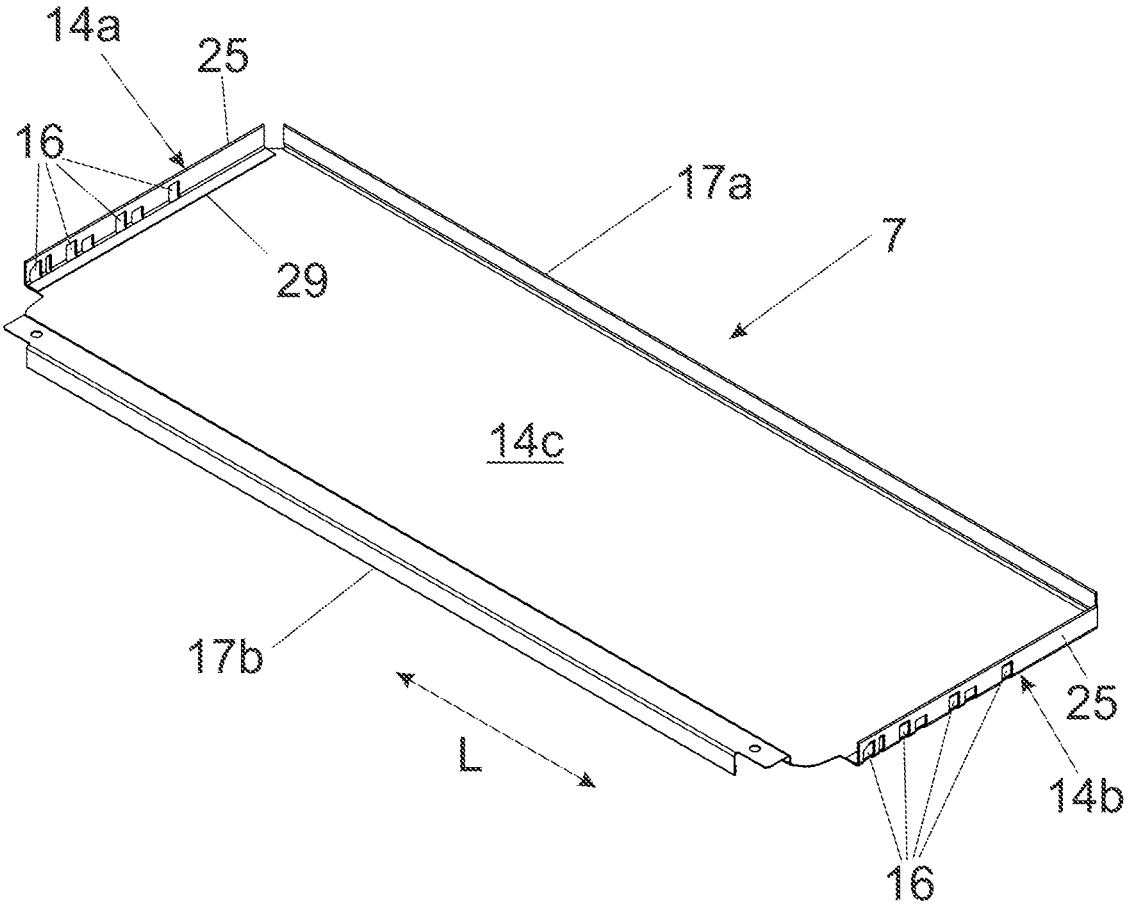
FIG. 7 shows the drawer rear wall as a finished product.

FIG. 7 shows the drawer rear wall 7 as a finished product. The wall thickness (W1) of the fastening portion 14*a*, 14*b* is at least twice as large, preferably precisely twice as large, than the second wall thickness (W2) of the middle portion 14*c*.

Each of the two edges 25 of the fastening portions 14*a*, 14*b* includes a plurality of openings 16 configured to at least partially receive the fastening elements 13, preferably locking elements, arranged on the sidewalls 8, 9. At least one of the two partial portions 29, preferably both partial portions 29, of the fastening portions 14*a*, 14*b* bears or bear against the middle portion 14*c*, whereby an undesirable deflection of the edges 25 in a direction facing towards the middle portion 14*c* can be prevented.

The invention claimed is:

1. A drawer rear wall for a drawer, the drawer rear wall comprising:

a first fastening portion for fixing the drawer rear wall to a first sidewall of the drawer;

a second fastening portion for fixing the drawer rear wall to a second sidewall of the drawer; and a middle portion, wherein the first and second fastening portions of the drawer rear wall are mutually spaced from one another in a longitudinal direction of the drawer rear wall by the middle portion, wherein a first wall thickness of at least one of the first and second fastening portions is larger than a second wall thickness of the middle portion, wherein the drawer rear wall has an integral one-piece configuration, wherein at least one of the first and second fastening portions is partially formed by a foldover of an edge of the middle portion, wherein the at least one of the first and second fastening portions partially formed by the foldover includes openings for partially receiving fastening elements arranged on a respective one of the first and second sidewalls, the openings being arranged so as to extend through the foldover, and wherein each said opening is arranged such that a periphery thereof is completely enclosed within the foldover and an entirety of each said opening is freely accessible on both sides of the foldover with respect to a thickness direction of the foldover.

2. The drawer rear wall according to claim 1, wherein the first wall thickness is at least substantially twice as large as the second wall thickness.

3. The drawer rear wall according to claim 1, wherein the first wall thickness is approximately 1.0 mm or the second wall thickness is approximately 0.5 mm.

4. The drawer rear wall according to claim 1, wherein the drawer rear wall comprises at least one metallic material.

5. The drawer rear wall according to claim 4, wherein the at least one metallic material includes steel or aluminum.

6. The drawer rear wall according to claim 1, wherein the middle portion is formed of an extruded profile.

7. The drawer rear wall according to claim 1, wherein the drawer rear wall includes at least one transverse limb extending over an entire length of the drawer rear wall and having a constant width.

8. The drawer rear wall according to claim 1, wherein the middle portion includes a first transverse limb having a first width, and at least one of the first and second fastening portions includes a second transverse limb having a second width, wherein the first width and the second width have substantially an identical size.

9. The drawer rear wall according to claim 1, wherein the middle portion includes at least two transverse limbs extending in the longitudinal direction in a parallel relationship, wherein one of the at least two transverse limbs of the middle portion is provided for supporting a drawer bottom.

10. The drawer rear wall according to claim 9, wherein the at least two transverse limbs project in different directions from the middle portion, or the at least two transverse limbs are mutually spaced from one another by a height of the middle portion.

11. A drawer comprising a first sidewall, a second sidewall, and the drawer rear wall according to claim 1, wherein the drawer rear wall is connected to the first sidewall via the first fastening portion and is connected to the second sidewall via the second fastening portion.

12. A drawer comprising a first sidewall, a second sidewall, and the drawer rear wall according to claim 11, wherein the drawer includes a front wall extending substantially parallel to the drawer rear wall, or includes a drawer bottom.

13. The drawer rear wall according to claim 1, wherein the first wall thickness of both of the first and second fastening portions is larger than the second wall thickness of the middle portion, wherein each of the first and second fastening portions is partially formed by a foldover of a respective edge of the middle portion, and wherein each of the first and second fastening portions includes openings for partially receiving fastening elements arranged on the first and second sidewalls, respectively, and wherein the fastening elements are locking elements.

14. A drawer rear wall for a drawer, the drawer rear wall comprising:

a first fastening portion for fixing the drawer rear wall to a first sidewall of the drawer;

a second fastening portion for fixing the drawer rear wall to a second sidewall of the drawer; and a middle portion, wherein the first and second fastening portions of the drawer rear wall are mutually spaced from one another in a longitudinal direction of the drawer rear wall by the middle portion, wherein a first wall thickness of at least one of the first and second fastening portions is larger than a second wall thickness of the middle portion, wherein the middle portion includes a mounting limb for connecting the middle portion to one of the first and second fastening portions, and wherein the mounting limb is connected to the middle portion by a step such that in a connected condition between the middle portion and the one of the first and second fastening portions, a front surface of the middle portion and a front surface of the one of the first and second fastening portions are flush with each other.

15. The drawer rear wall according to claim 14, wherein either:

the one of the first and second fastening portions includes a spring element for pressing the mounting limb against a wall of the one of the first and second fastening portions; or the mounting limb comprises a first mounting limb and a second mounting limb for connecting the middle portion to the first and second fastening portions, respectively, the first fastening portion includes a spring element for pressing the first mounting limb against a wall of the first fastening portion, and the second fastening portion includes a spring element for pressing the second mounting limb against a wall of the second fastening portion.

16. The drawer rear wall according to claim 14, wherein the middle portion and at least one of the first and second fastening portions are configured to be connected to one another by at least one mounting device.

17. The drawer rear wall according to claim 16, wherein the middle portion is configured to be releasably connected to each of the first and second fastening portions by one said mounting device, wherein each said mounting device includes at least one plug connection, a locking connection, or a snap-connection device.

* * * * *